United States Patent [19]

Desourdy

[11] 3,976,146

[45] Aug. 24, 1976

[54] GRADER

[76] Inventor: Bernard Desourdy, 309 deNormandie St., Longueuil, Quebec, Canada

[22] Filed: May 14, 1975

[21] Appl. No.: 577,401

[30] Foreign Application Priority Data

Mar. 13, 1975 Canada ..... 222012

[52] U.S. Cl. ..... 172/788; 172/791; 172/792; 172/793; 172/795; 172/797; 280/638

[51] Int. Cl.[2] ..... E02F 3/76

[58] Field of Search ..... 172/780–797, 172/806; 280/34 R

[56] References Cited

UNITED STATES PATENTS

| | | | |
|---|---|---|---|
| 940,169 | 11/1909 | Lathrop | 280/34 R UX |
| 1,106,104 | 8/1914 | Marx | 280/34 R |
| 2,450,905 | 10/1948 | Mork | 172/806 |
| 2,511,692 | 6/1950 | Brown | 280/34 X |
| 3,036,392 | 5/1962 | Marvin et al. | 172/780 |
| 3,266,180 | 8/1966 | Toland | 172/780 |
| 3,381,760 | 5/1968 | Braud | 172/788 |
| 3,450,213 | 6/1969 | Creighton et al. | 172/781 X |
| 3,527,315 | 9/1970 | Hampton | 172/781 X |

FOREIGN PATENTS OR APPLICATIONS

| | | | |
|---|---|---|---|
| 138,511 | 5/1949 | Australia | 172/788 |

*Primary Examiner*—Paul E. Shapiro

[57] ABSTRACT

A grader of the type including a longitudinal overlying boom connecting a front wheel assembly to a rear tractor unit with a blade carrier frame assembly positioned intermediate the front wheels assembly and the tractor unit. This grader is characterized by a boom which is longitudinally adjustable, laterally swingable and mounted over the cab to allow selective adjustment between a maximum effective wheelbase and a minimum turning radius to allow a lower cab and overall profile of the grader, and to provide an increased effective field of vision to the operator and to provide roll-over protection for the operator. This grader also distinctively includes a blade, the carrier frame of which is rearwardly connected to the tractor unit rather than forwardly to the boom, such as to be pushed by the tractor unit instead of being drawn by the boom, to thus allow a boom of lighter construction.

7 Claims, 8 Drawing Figures

GRADER

This invention relates to a grader and, in particular, to a grader of the conventional type including an overlying longitudinal boom connecting a front wheels assembly to a rear tractor unit.

The graders of the above type which have been proposed so far include a boom which stands in the normal field of vision of the operator and to which the blade is connected to be drawn by the front end of the boom. This connection of the blade requires a very strong and heavy boom construction to provide the required strength to the boom. Besides, the booms of the anteriorly proposed graders of the above type are longitudinally fixed relative to the tractor unit, which defines both a fixed turning radius and a fixed wheelbase.

It is a general object of the present invention to provide an improved grader of the above type, and in particular, wherein the boom thereof is longitudinally adjustable to afford the possibility to select between a short wheelbase for a small turning radius and a long wheelbase for reduced pitching of the grader and thus more evenness in the grading.

It is another general object of the present invention to provide a grader of the above type wherein the boom is arranged over the cab to relatively greatly increase the effective field of vision of the operator and to provide roll-over protection for the latter.

It is a further general object of the present invention to provide a grader of the above type, wherein the cab is arranged in a lowered position to allow a lower cab and overall profile of the grader, and wherein the boom is swingable laterally of the grader to further shorten the turning radius.

The above and other objects and advantages of the present invention will be better understood with the following detailed description of a preferred embodiment thereof which is illustrated, by way of example, in the accompanying drawings, wherein.

Figure 1:
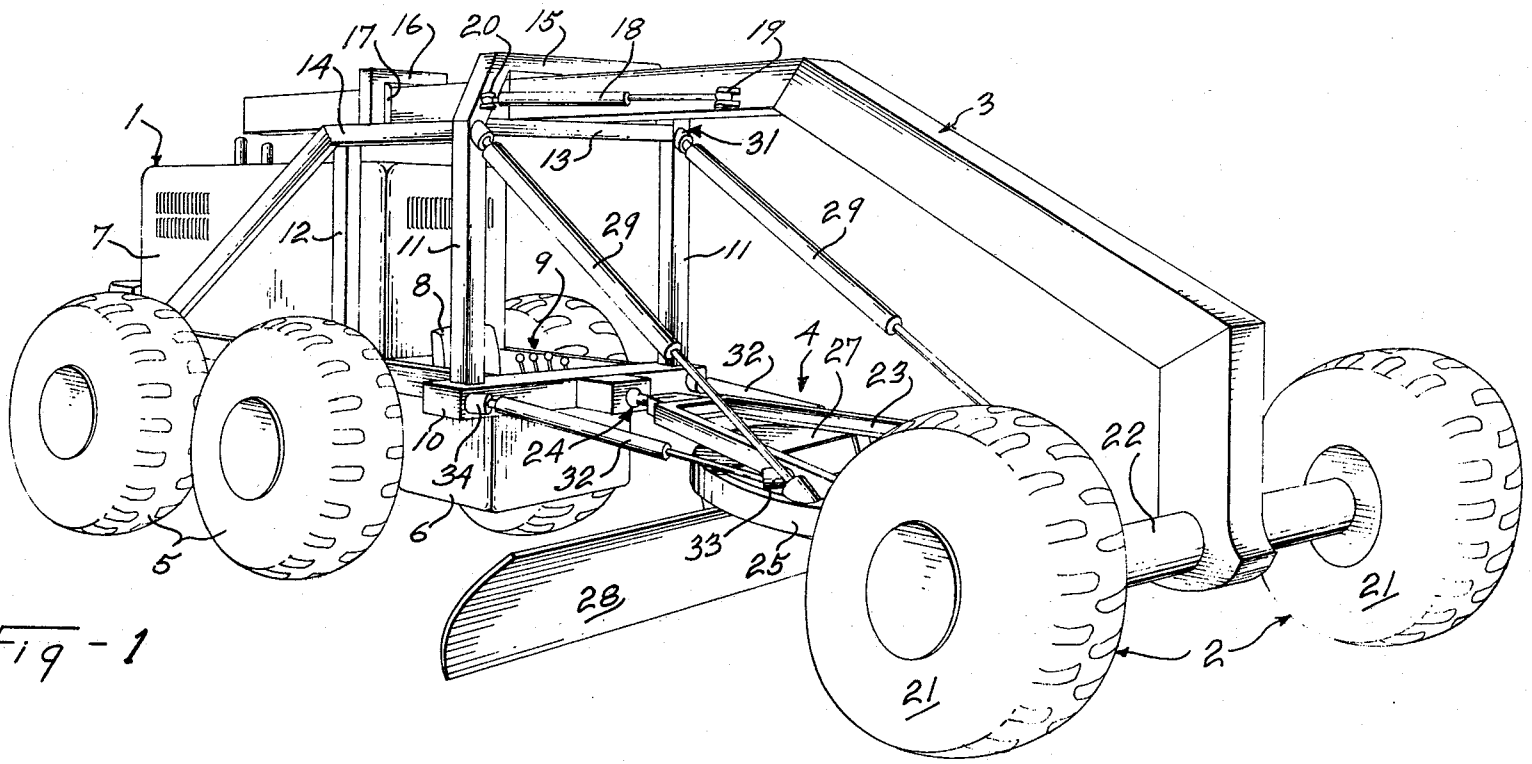
FIG. 1 is a perspective view of a grader according to the present invention.
Figure 3B:
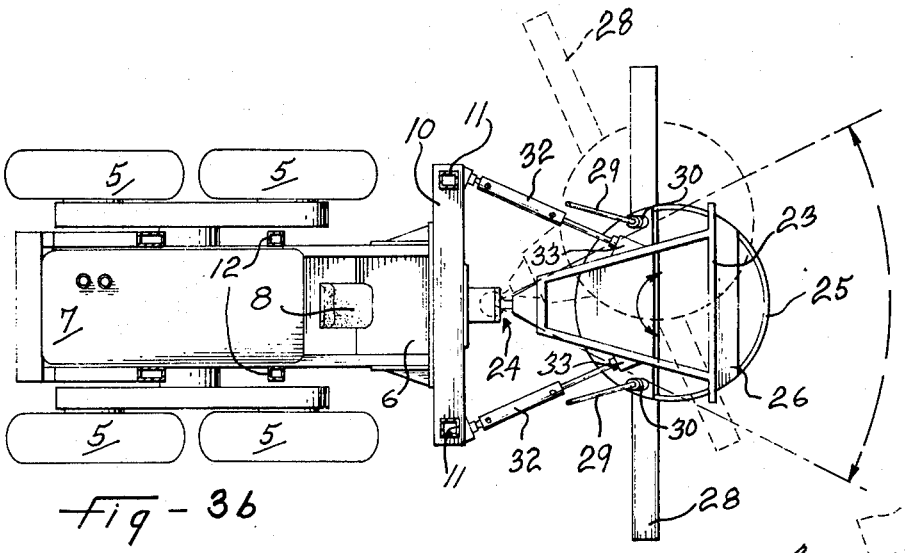
Figure 3A:
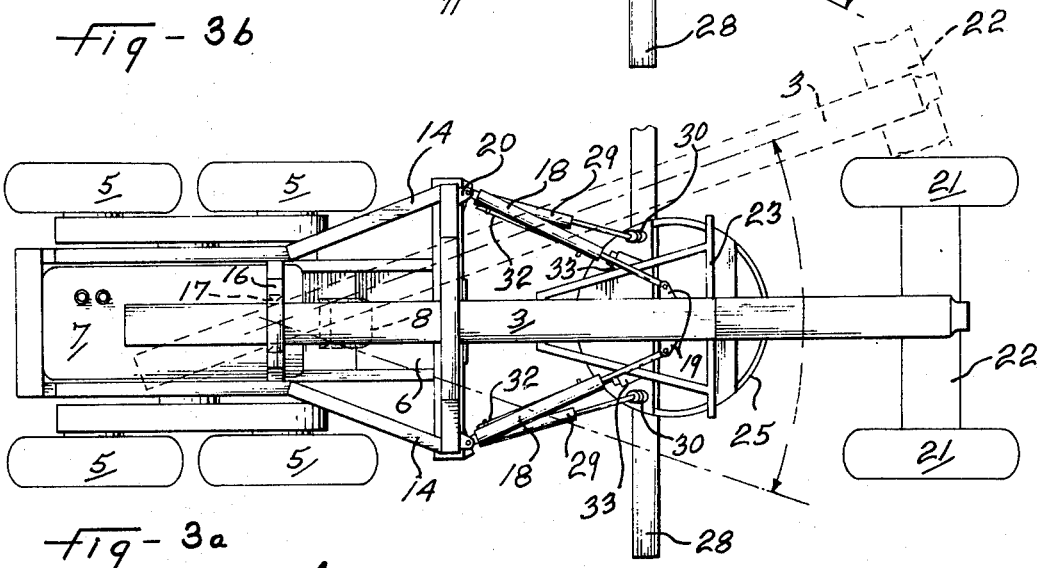
Figure 2:
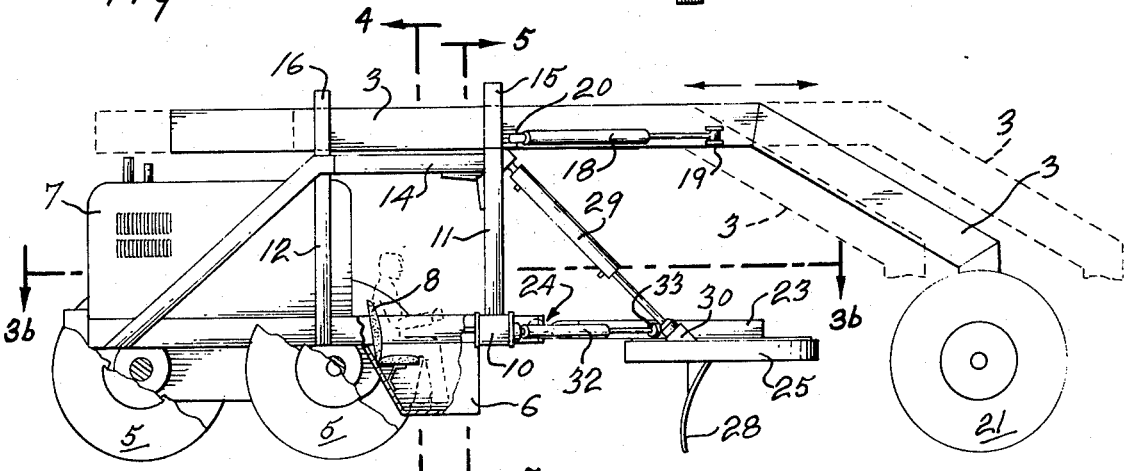
FIG. 2 is a side elevation view of the grader of FIG. 1.
Figure 4:
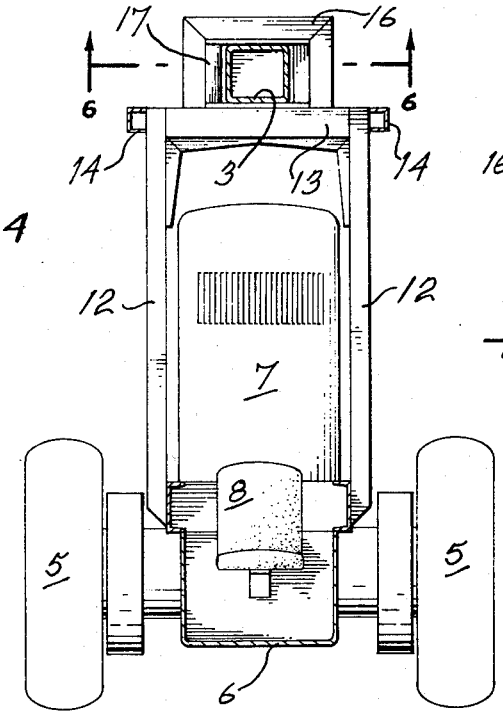
Figure 6:
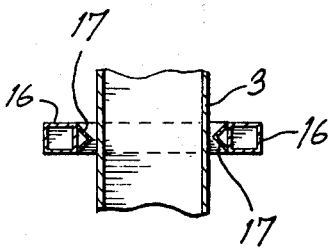
Figure 5:
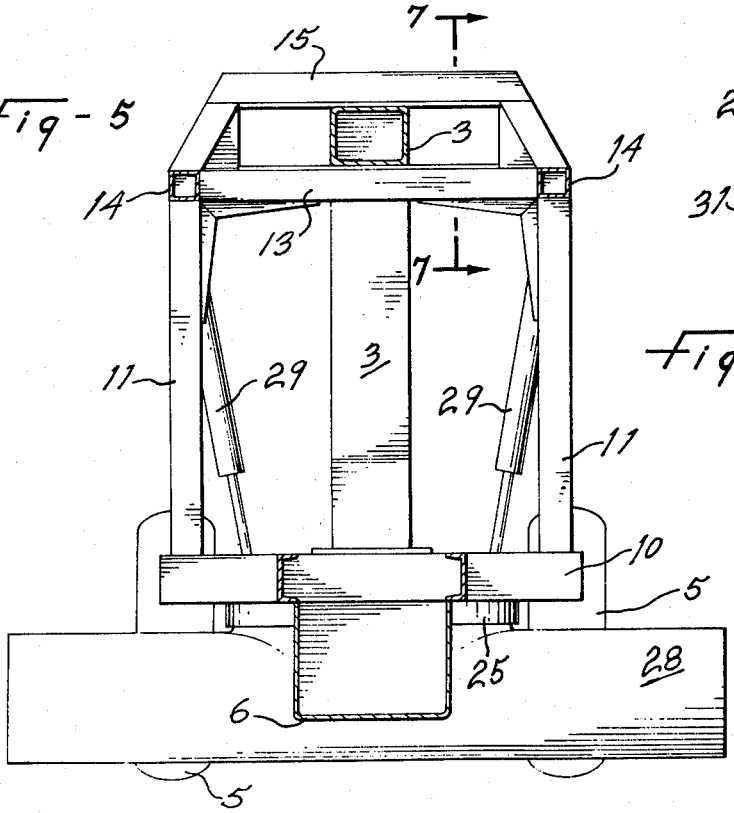
Figure 7:
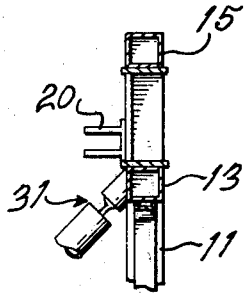

FIG. 3*a* is a top view of the same grader, illustrating the lateral swinging of the boom;

FIG. 3*b* is a sectional view as seen along line 3*b*—3*b* in FIG. 2;

FIGS. 4 and 5 are cross-sectional views as seen along lines 4—4 and 5—5 respectively in FIG. 2;

FIG. 6 is a cross-sectional view of the pivotal and slidable boom mounting on top of the cab, as seen along line 6—6 in FIG. 4; and FIG. 7 is a cross-sectional view as seen along line 7—7 in FIG. 5.

The illustrated grader includes a rear tractor unit 1, a front wheel assembly 2, a longitudinal boom 3, and a blade carrier frame assembly 4, all to be hereinafter referred to in more details.

The tractor unit 1 includes wheels 5, a frame 6 and an engine 7 of conventional construction and interconnection. The frame 6 of the tractor unit projects forwardly of the engine 7 and forms a pit, as best shown in FIG. 2, constituting the bottom portion of the operator's cab, the top portion of which is not shown for the sake of clarity. The operator's seat 8 and control 9 are mounted in the afore-mentioned pit.

A cross beam 10 is secured against the front of the pit defined by the frame 6 of the tractor unit and posts 11 and 12 project upright from the cross beam 10 and the tractor frame 6 respectively and are rigidly interconnected by cross bars 13 and rearwardly converging braces 14. A front cross beam 15, of substantially inverted U-shape, has its free ends secured to the top end of the posts 11 to upwardly restrain the boom 3 while allowing both lateral and longitudinal sliding of the latter relative to the front cross bar 13. A rear cross beam 16, also of inverted U-shape, similarly has its free ends secured to the top end of the posts 12 and has a pair of upright leg members laterally spaced apart from each other transversely of the rear tractor unit and defining between them a rectangular passage over the rear cross beam 13, as best shown in FIG. 4. This allows fore and aft endwise sliding of the boom 3 in this rectangular passage. Upwardly extending ridge members 17 are secured against the internal side of each upright leg of the rear U-shape cross beam 16 and form lateral fulcrums defining an upright steering axis for the boom 3 which is supported on the cross beam 16 between the ridge members 17. Thus, the boom 3 is longitudinally slidable on the front and rear crossbars 13 and laterally slides on the front crossbar 13 upon pivoting about the upright steering axis defined by the ridge members 17. A pair of hydraulic cylinders 18 are pivoted at one end to the boom 3 and at the other end to the front U-shape cross beam 15 to produce the aforementioned fore and aft steering displacements of the boom 3. It must be noted that each hydraulic cylinder 18 forms a single pivot pin connection with the boom 3 and the front U-shape cross beam 15 through the brackets 19 and 20 respectively.

The front wheels assembly includes the front wheels 21 which are steerably interconnected in any known manner through a supporting transverse tubular casing 22. The latter is centrally secured to the front end of the boom 3, such that the front wheels assembly 2 is carried by the latter and bodily displaceable therewith. Thus, when the boom 3 is swung, the front wheels 21 are bodily swung therewith, as shown in dotted lines in FIG. 3*a*, and this, in effect, produces a corresponding steering of the front wheels which may additionally be steered relative to the boom 3.

As shown in FIGS. 4, 5, and 6, the boom 3 is made hollow and of rectangular cross-section, and, since it does not draw the blade assembly 4, as hereinafter explained, it is made relatively smaller and lighter as compared to the booms which have to draw a blade assembly.

The blade carrier frame assembly includes a blade carrier frame 23 pivotally secured to the bottom cross beam 10 by a ball and socket pivotal connection 24. As best shown in FIG. 2, the frame 23 is free at its front end relative to the boom 3 and is thus pushed by the tractor unit 1. A circle 25, of any known construction, is rotatably mounted under the frame 23 by transverse shoe carrier plates 26 and 27 in any conventional manner. A scraping blade 28 is rigidly secured to the circle 25 for bodily displacement therewith.

A pair of hydraulic cylinders 29 are secured at one end to the frame 23 and at the other end to the top end of the front posts 11 by ball and socket connections 30 and 31 respectively. Another pair of hydraulic cylinders 32 are secured at one end to the circle 25 and at the other end to the bottom cross beam 10 by ball and socket connections 33 and 34 respectively. The hydraulic cylinders 29 are diagonally directed and adapted to laterally tilt and swing the blade carrier frame assembly and also to elevate and lower the latter about the universal pivot points defined by the ball and socket connections 24. The hydraulic cylinders 32 serve to rotate the circle 25 and thus angularly set the blade 28 transversely of the frame 23.

It must be noted that the afore-described grader provides the known straight, articulated and crab operations and the elevation and tilt of the scraping blade; but, in addition, it provides longitudinal extension and retraction of the boom 3 and thence selective adjustment of the wheelbase and of the turning radius.

What I claim is:

1. A grader comprising, in combination, a rear tractor unit having a cab mounted thereon, a front wheel assembly arranged forwardly of the rear tractor unit, a blade carrier frame assembly positioned intermediate the rear tractor unit and the front wheel assembly, a boom extending lengthwise fore and aft in overhead elevated position over said cab and said blade carrier frame assembly and having a front end connected to the front wheel assembly and bodily displaceable therewith, a support mounted on said rear tractor unit, defining an upright steering axis and a fore and aft sliding passage for the boom, and both pivotally and slidably carrying the rear end of the boom in engagement in the fore and aft sliding passage, and an actuation means connected to said tractor unit and to said boom and operatively displacing the latter both pivotally about said upright steering axis and fore and aft endwise in said sliding passage.

2. A grader as defined in claim 1, wherein said support includes a pair of upright leg members laterally spaced apart from each other transversely of the rear tractor unit, cooperatively defining a pair of mutually facing internal faces respectively, and having a pair of upright ridges upwardly extending along said internal faces respectively and defining said upright steering axis.

3. A grader as defined in claim 1, further including hydraulic cylinders pivoted at one end to the blade carrier frame assembly and at the other end to the tractor unit and operatively actuating the blade carrier frame assembly relative to the tractor unit.

4. A grader as defined in claim 3, wherein a universal pivot connection connects the rear end of said frame to the tractor unit, and said hydraulic cylinders include one pair of cylinders connected to said frame and arranged to elevate and lower and to laterally swing and tilt said frame.

5. A grader as defined in claim 4, wherein the blade carrier frame assembly includes a blade, a circle rotatably carrying said blade underneath said frame, and said hydraulic cylinders include a second pair of hydraulic cylinders pivotally connecting said circle to the rear tractor unit for angular adjustment of the blade about an upright axis.

6. A grader as defined in claim 5, wherein each of said hydraulic cylinders of said one and said second pairs includes universal pivot connections at opposite ends thereof.

7. A grader as defined in claim 6, wherein said support includes a pair of upright leg members laterally spaced apart from each other transversely of the rear tractor unit, cooperatively defining a pair of mutually facing internal faces respectively, and having a pair of upright ridges upwardly extending along said internal faces respectively and defining said upright steering axis.

* * * * *